US005505047A

United States Patent [19]

Hirose et al.

[11] Patent Number: 5,505,047

[45] Date of Patent: Apr. 9, 1996

[54] GAS COMPRESSION/EXPANSION APPARATUS

[75] Inventors: Tatuya Hirose; Naohide Tanigawa, both of Oizumi; Rikio Tadano, Ogo, all of Japan

[73] Assignee: Sanyo Electric Co., Ltd., Osaka, Japan

[21] Appl. No.: 345,699

[22] Filed: Nov. 21, 1994

[30] Foreign Application Priority Data

Nov. 30, 1993 [JP] Japan ..... 5-323382

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,412,423 | 11/1983 | Durenec | 62/6 |
| 4,479,358 | 10/1984 | Lam | 62/6 |
| 4,543,793 | 10/1985 | Chellis et al. | 62/6 |
| 4,846,256 | 7/1989 | nee Erosi | 62/6 |
| 5,259,197 | 11/1993 | Byung-Mu | 62/6 |

FOREIGN PATENT DOCUMENTS 1-38178 8/1989 Japan .

*Primary Examiner*—Ronald C. Capossela

*Attorney, Agent, or Firm*—Armstrong, Westerman, Hattori, McLeland & Naughton

[57] ABSTRACT

An apparatus is provided for compressing/expanding a refrigerant gas. The pistons 13 and 16 for use in the apparatus each have cavities formed in the pistons 13 and 16, and check valves 40 and 41 mounted on one end of the respective pistons for closing/opening the cavities so that the cavities are filled with the pressurized gas. The pistons also have a multiplicity of bores 42 and 43 communicating with the respective cavities for ejecting the high pressure gas into respective gaps between the pistons and cylinders accommodating the pistons. The ejected gas forms gas bearings for the pistons, keeping the pistons off the cylinders, thereby eliminating any mechanical friction between them and hence wear of the pistons and the cylinders. This helps significantly prolong life time of the apparatus.

4 Claims, 4 Drawing Sheets

GAS COMPRESSION/EXPANSION APPARATUS

FIELD OF THE INVENTION

The invention relates to a gas compressor/expander for compressing/expanding a gas in a cylinder by cyclic operation of a piston in the cylinder.

BACKGROUND OF THE INVENTION

A typical compressor employs a reciprocal piston for compressing a gas in a cylinder. A similar apparatus having basically the same structure as the compressor may be used for expanding a gas in a cylinder (hereinafter referred to as gas expander). In such compressor and expander, it is most important on one hand to keep the piston closely in contact with the cylinder to suppress gas leak from the cylinder as much as possible. On the other hand piston must be loose enough to reduce the friction between the piston and the cylinder for smooth operation of the piston.

A known approach to attain these seemingly opposite objectives is to provide the piston and the cylinder with a lubricant forming a thin layer between them. This lubricant layer only decreases the friction, but also helps seal the gap between the piston and the cylinder. However, any lubricant can evaporate into the gas under compression/expansion of the gas in the cylinder. The diffused lubricant will degrade thermal properties of the refrigerant and some components of the apparatus in the long run.

In order to circumvent such deterioration caused by the lubricant, it is necessary to keep the gas clean. This may be attained by the use of a lubricant-free compressor/expander, in which the piston is reciprocated without lubricants. Known lubricant-free apparatuses, however, have disadvantages that the piston-cylinder system are likely to have large friction and thus will suffer from quick wear, thereby shortening the life of the apparatus. In order to minimize such friction in the lubricant-free piston-cylinder system, the system must be designed to allow for a uniform gap of about 10 microns and yet to strictly suppress transverse fluctuation of the piston rod during its reciprocal motions, which is a burden in design and manufacture of the apparatus.

SUMMARY OF THE INVENTION

To overcome the aforementioned problems encountered in conventional gas compressor/expander, the invention discloses an improved lubricant-free gas compressor/expander. The lubricant-free compressor/expander of the invention utilizes a piston-cylinder system in which the gap between the piston and the cylinder is minimized but yet the piston may reciprocate in a cylinder without contacting the wall of the cylinder (herein referred to as non-contact type piston-cylinder). This non-contact type piston-cylinder system has no friction between them and providing a long life to the piston-cylinder system.

In one aspect of the invention, there is provided a compression/expansion apparatus for compressing/expanding a gas in a cylinder by reciprocating a piston in the cylinder. One of the features of the invention is that the piston has: a cavity in the piston; an opening formed in at least one of the opposite ends of the piston, and communicating with the cavity; a check valve mounted on the opening for allowing the gas to flow from the cylinder into the cavity when the pressure of the gas is higher in the cylinder than in the cavity so as to maintain the pressure of the gas higher in the cavity than in the cylinder; and a multiplicity of bores communicating between the cavity and a cylindrical surface of the piston for ejecting the high pressure gas from the cavity into a gap between the piston and the cylinder.

With this piston-cylinder system, the gas ejected from the piston bores forms a gas layer or "gas bearing" to maintain the piston off the wall of the cylinder wall, eliminating the friction between the piston and the cylinder. Since the piston and the cylinder are kept off from each other by the gas bearing, they experience no wear, so that the apparatus is greatly improved in its durability. Also, since only a minute gap is necessary between the cylinder and the piston, additional design to suppress transverse fluctuations of the piston rod is not necessary. This greatly relaxes manufacturing design conditions for the apparatus.

The piston preferably has at least one piston ring on its cylindrical circumference. As is well known to a person of the skill that a piston ring has better durability than a piston, so that it may provide further durability of the piston. At the same time, the piston ring relaxes precision requirement of the piston, since the piston having a piston ring is only required to be moderately smaller in diameter than the cylinder. Such piston ring of the invention has, on its cylindrical surface, a plurality of bores communicating with the cavity for ejecting the high pressure gas into a gap between the piston ring and the wall of the cylinder, thereby forming a gas bearing between the piston and the wall of the cylinder.

In another aspect of the invention, there is provided a Stirling's engine type refrigerator, having: a gas compressor and a gas expander of the type described above; a gas passage connecting a compression space of the gas compressor with an expansion space of the gas expander; and a low-temperature regenerator provided in the gas passage. In this lubricant-free and contact-free apparatus the gas compressor and the gas expander are cyclically operated out of phase by a predetermined phase angle, serving as a durable refrigerator.

DETAILED DESCRIPTION OF THE PREFERRED EMBODIMENT

While the invention is applicable to any piston-cylinder type compression/expansion apparatus, a specific embodiment of the invention will be described in detail by way of example in connection with a stirling refrigeration apparatus with reference to accompanying drawings.

Figure 1:
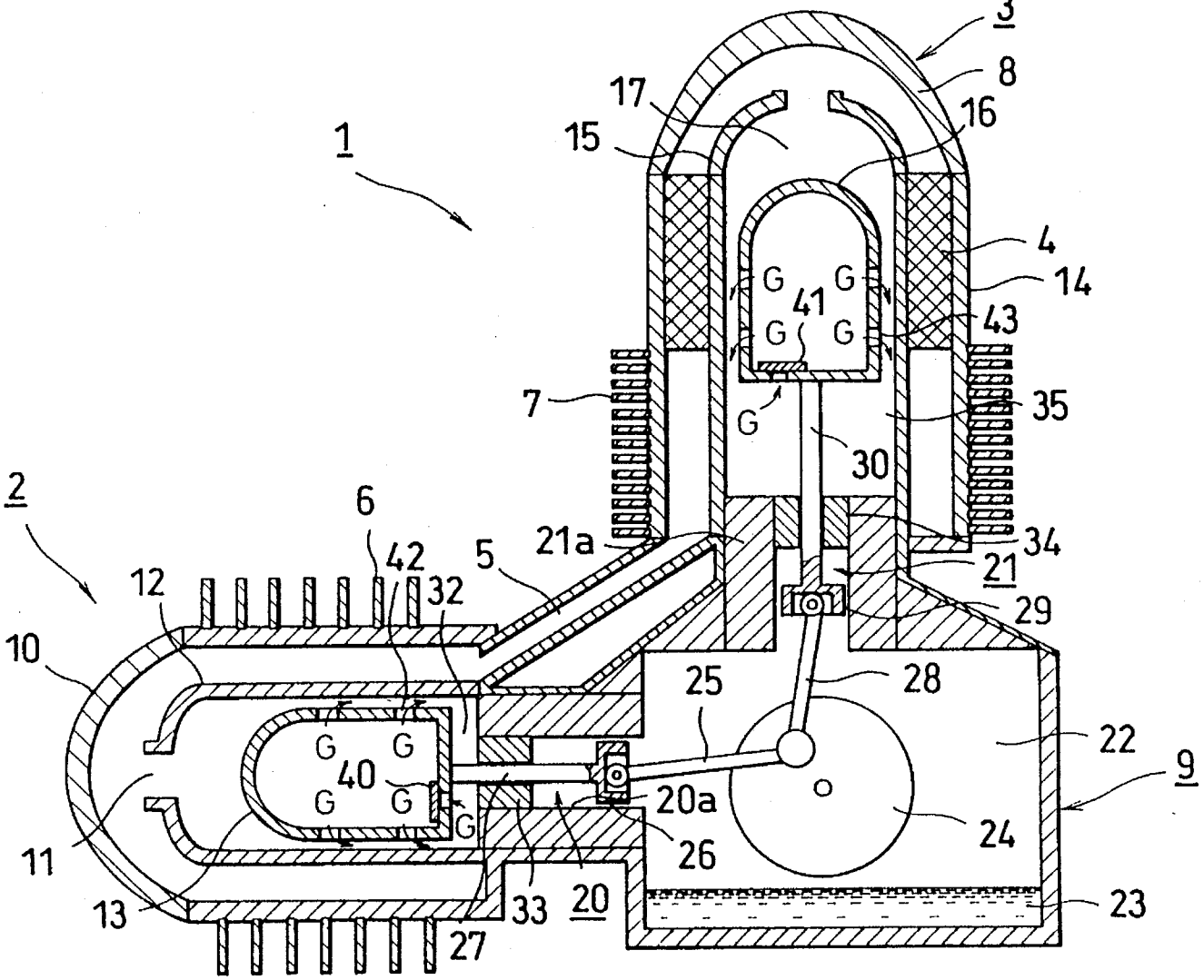
FIG. 1 is a schematic cross section of a first embodiment of the invention, showing the concept of a stirling type refrigerator.

Referring now to FIG. 1, there is shown a schematic view of a stirling refrigeration apparatus 1 according to the invention. The apparatus 1 includes a gas compressor 2 and a gas expander 3 connected with the gas compressor 2 through a gas passage 5 via a low temperature regenerator 4. The gas passage 5 has a heat radiator 6 at one end thereof proximate to the gas compressor 2, and another heat radiator 7 at the other end thereof proximate to the entrance of the regenerator 4. Provided at the top of the gas expander 3 is a low-temperature heat conduction port 8. A crank box 9 is arranged to the right of the gas compressor 2 and beneath the gas expander 3 for driving the gas compressor 2 and the gas expander 3.

When driven by a crank mechanism 24 in the crank box 9, the gas compressor 2 is operated to compress cryogenic refrigerant such as helium, providing compressed refrigerant gas to the gas expander 3 through the gas passage 5. The gas compressor 2 has a horizontally extending cylinder 12 in a cylindrical compressor body 10. The compression cylinder 12 accommodates therein a compression piston 13. The gas compressor 2 also has at its head section a compression space 11.

The gas expander 3 serves to receive and expand the compressed refrigerant gas delivered from the gas compressor 2 via the regenerator 4. The gas expander 3 has an expansion cylinder 15 in a vertical body 14 of the expander 3. The expansion cylinder 15 accommodates a piston 16. Provided at its head section of the gas expander 3 is an expansion space 17 serving as a heat sink or a negative-heat generator.

The regenerator 4 is an annular porous body, installed in a space between the inner wall of the expansion cylinder 15 and the outer wall of the expander body 14. The regenerator 4 serves to cool the compressed refrigerant gas before the gas is delivered from the gas passage 5 to the gas expander 3 prior to an expansion process. The regenerator 4 is cooled by the cold refrigerant gas following an expansion in the cylinder 3 as the expanded gas is returned from the expander 3 to the compressor 2 through the regenerator 4. Thus, the regenerator serves as a low-temperature regenerator or a negative-heat source for the next refrigeration cycle. The regenerator 4 has numerous minute gas passages for better heat transfer between the refrigerant gas, and is made of a material having a large heat capacity such as copper, stainless steel, and lead.

The gas passage 5, connecting between the gas compressor 2 and gas expander 3, is configured to provide a uniform flow of the gas to the entrance of the regenerator 4. The heat radiator 5 has a plurality of annular fins on the outer surface of the compressor body 10. The heat radiator 7 also has a plurality of annular fins on the outer surface of the expander body 14. The heat radiators 6 and 7 absorb heat from the compressed hot gas passed from the gas compressor 2, and radiate the heat to thereby cool the gas to a lower temperature e.g. room temperature before the gas is cooled by the regenerator 4. The low-temperature heat conduction port 8 is made of a metal plate such as stainless steel plate, covering the top of the expander body 14, so that it may provide negative heat generated in the expansion space 17 to, or absorb heat from, a low-temperature heat chamber (not shown) connected with it, refrigerating the heat chamber.

The crank box 9 has a crank room 22 which stores a lubricant. 23 at the bottom section of the room 22. The box 9 also accommodates the crank mechanism 24 as mentioned above. The crank mechanism 24 is operably connected with a motor (not shown) and designed to transform the rotational motion of the motor into reciprocal motions of the pistons 13 and 16 via connecting rods 25 and 28. In order to accomplish this transformation of power, guides 20 and 21 are provided between the crank box 9 and the rear ends of respective cylinders 12 and 13.

The connecting rod 25 is connected at one end with the crank mechanism 24 and at the other end with a first cross guide 26 which is slidably mounted on a first guide receiver 20a of the guide 20. The cross guide 26 is in turn connected with a piston rod 27 mounted on the rear end of the piston 13. Similarly, the connecting rod 28 connected at one end thereof with the crank mechanism 24 and at the other end with a second cross guide 29 which is slidably mounted on a second guide receiver 21*a* of the guide 21. The cross guide 29 is connected with a piston rod 30 mounted on the lower end of the piston 16.

In order to prevent the lubricant 23 from entering a rear space 32 behind the piston 13, the guide 20 is provided with an oil seal 33. The guide 21 is provided with a similar oil seal 34 to prevent the lubricant from entering a space 35 beneath the piston 16. Thus, because of the oil sealant, spaces inside the compression cylinder 12 and the expansion cylinder 15 are kept free of lubricant.

In order to allow smooth motion of the pistons 13 and 16 in the cylinders 12 and 15 without lubricant, the pistons 13 and 16 are each provided with cavities therein and openings in their rear ends, and with a multiplicity of bores on the respective cylindrical peripheries for ejecting the gas induced in the cavities. The openings are provided with respective check valves 40 and 41, which operates as described later.

Figure 2:
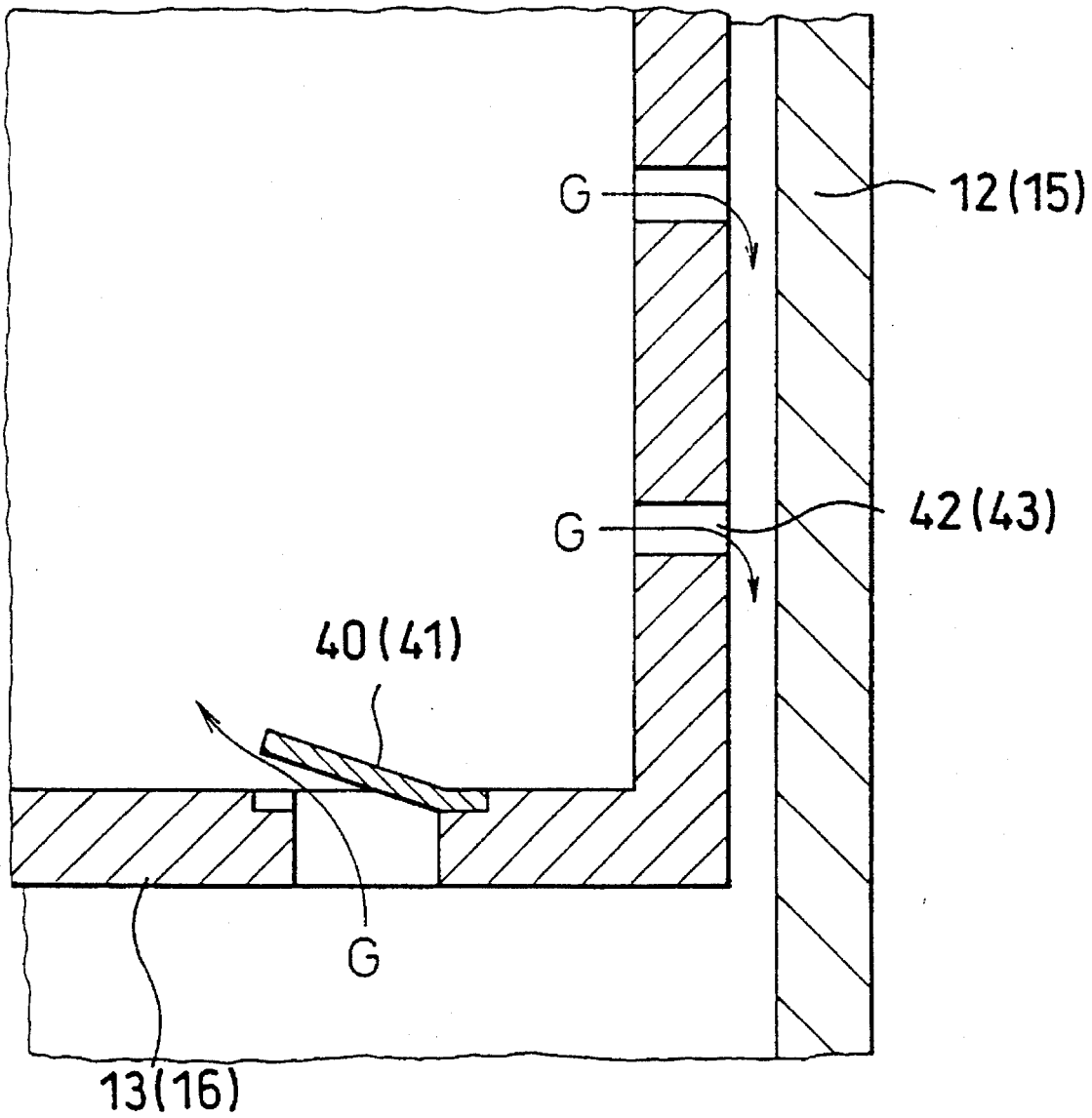
FIG. 2 is an enlarged partial view of the refrigerator of FIG. 1.

Referring now to FIG. 2, there is shown portions of check valves of the pistons 12 and 16 on the same enlarged diagram. The reference numbers in the parentheses are for the like portions of the piston 16 corresponding to the piston 12. Each of the check valves 40 and 41 may open when the pressure of the gas in each piston 13 or 16 is lower than the pressure of the gas outside the piston, and shut the openings otherwise. It should be understood that the locations and the number of these check valves are not limited as described above, but are arbitrary so long as they may control the flow of the gas in the manner as stated above. Hence, they may be installed on their front ends of the pistons, for example. It should be also understood that the number and the locations of the bores are arbitrary so long as they may eject sufficient amount of the gas into the respective gaps between the pistons and the cylinders, forming "gas bearings" for ensuring smooth reciprocal motions of the pistons. It should be noted that the size (or sizes) of the bores are sufficiently small so as not to make the pressure inside the pistons negative relative to the pressure outside the pistons.

Basic operation of the Stirling refrigeration apparatus of the invention described above is as follows. At the beginning of a refrigeration cycle, the crank mechanism 24 in the crank box 9 is driven by a motor (not shown), pushing the piston 13 of the compression cylinder 12 forward in the compression cylinder 12, compressing the refrigerant gas such as helium or nitrogen filling the compression space 11. The gas is supposedly not condensed in this compression. The compressed refrigerant gas is pumped out of the compression space 11 into the gas passage 5. At the entrance of the gas passage 5 the compressed gas looses its heat through the heat radiator 6 provided on the outer surface of the compressor body 10. The gas is further cooled by the heat radiator 7 at the exit of the gas passage 5 before the gas is further transported into the regenerator 4.

As the refrigerant gas is passed through the regenerator 4, it is further cooled. The gas is finally collected in the expansion space 17 of the gas expander 3, building up its pressure therein.

Then the piston 16 of the gas expander 3, is then promptly lowered in the expansion cylinder 15 by the action of the crank mechanism 24, which results in a sudden increase in the volume of the expansion space 17 and hence the refrigerant gas therein is subjected to an adiabatic expansion. This cools the gas significantly. It will be noted that, as shown in the FIG. 1, that the piston 16 is out of phase by 90° from the compression cylinder 12.

The piston 16 is pushed upward shortly, meanwhile the piston 13 is retracted in the backward direction in the compression cylinder This causes the low-temperature refrigerant gas to return from the gas expander 3 to the gas compressor 2 through the regenerator 4, where the gas absorbs heat from the regenerator 4, giving off some "negative heat" to the regenerator 4 to be utilized in the next cycle. The compression cylinder 12 will be fully retracted in the compression cylinder 12. This completes one compression-expansion cycle.

Such cycle is repeated continuously by the crank mechanism 24, until the refrigerant gas is cooled to a desired temperature, creating sufficient amount of negative heat in the expansion space 17 of the gas expander 3. The expansion space 17 is now capable of serving as a heat sink to an external load through the heat conduction port 8.

At this point it would be appropriate to note that, if a lubricant is used in the cylinders 12 and 15, the lubricant will diffuse into the refrigerant gas during refrigeration cycles, which will degrade the refrigerant gas. Such diffused lubricant will also lowers heat transfer coefficient of the regenerator 4 by accumulates therein. Thus, the performance of the refrigerator will be eventually lost. In order to prevent such adversity caused by the lubricant, the invention avoids lubrication by diffusive material (normally oil) by preventing the lubricant from entering into the cylinders from the crank box 9 by means of the oil seals 33 and 34. These oil seals 33 and 34 may shut off the lubricant from the compression cylinder 12 and the expansion cylinder 15.

On the other hand, without any lubricant, the pistons 13 and 16 will experience contact forces or frictions between the pistons and the inner walls of the cylinders unless some appropriate measure is taken. Such friction will inevitably shorten the life of the apparatus. In order to avoid such friction, the invention uses the check valves 40 and 41 provided on the back ends of the respective pistons for opening/closing the openings of the cavities in the respective pistons, in combination with the plurality of bores 42 and 43 communicating between the cavities and the peripheries of the respective pistons.

When the pressure in the rear space 32 exceeds the pressure in the piston cylinder 12 towards the end of each cycle, the check valve 40 is opened to introduce the gas from the rear space 32 into the cavity of the piston 12 until the pressures on both sides of the valve 40 balance. The valve 42 is closed as the piston is driven forward and the pressure in the rear space 32 lowers. It should be noted that the sizes of the bores 42 are very small that the amount of the gas ejected during subsequent forward motion of the piston is small, and hence that the pressure in the cavity is always higher than the pressure of the gas outside the piston.

As a result of ejection of the gas from the bores 40, a gas bearing is formed between the otherwise contacting surfaces of the piston and the cylinder wall, which gas bearing successfully keeps the piston afloat in the compression cylinder 12, causing no wear of the piston 13 and the compression cylinder 12. The same principle applies to the piston 16 in the cylinder 15 of the gas expander 3. It should be noted that elimination of wear of the pistons and the cylinders ensures prevention of possible transverse fluctuations that would take place for a worn piston in a worn cylinder. Since no mechanical requirement is imposed on the piston-cylinder system to suppress such transverse fluctuations, manufacturing cost of a refrigeration apparatus of the invention may be reduced.

Figure 3:
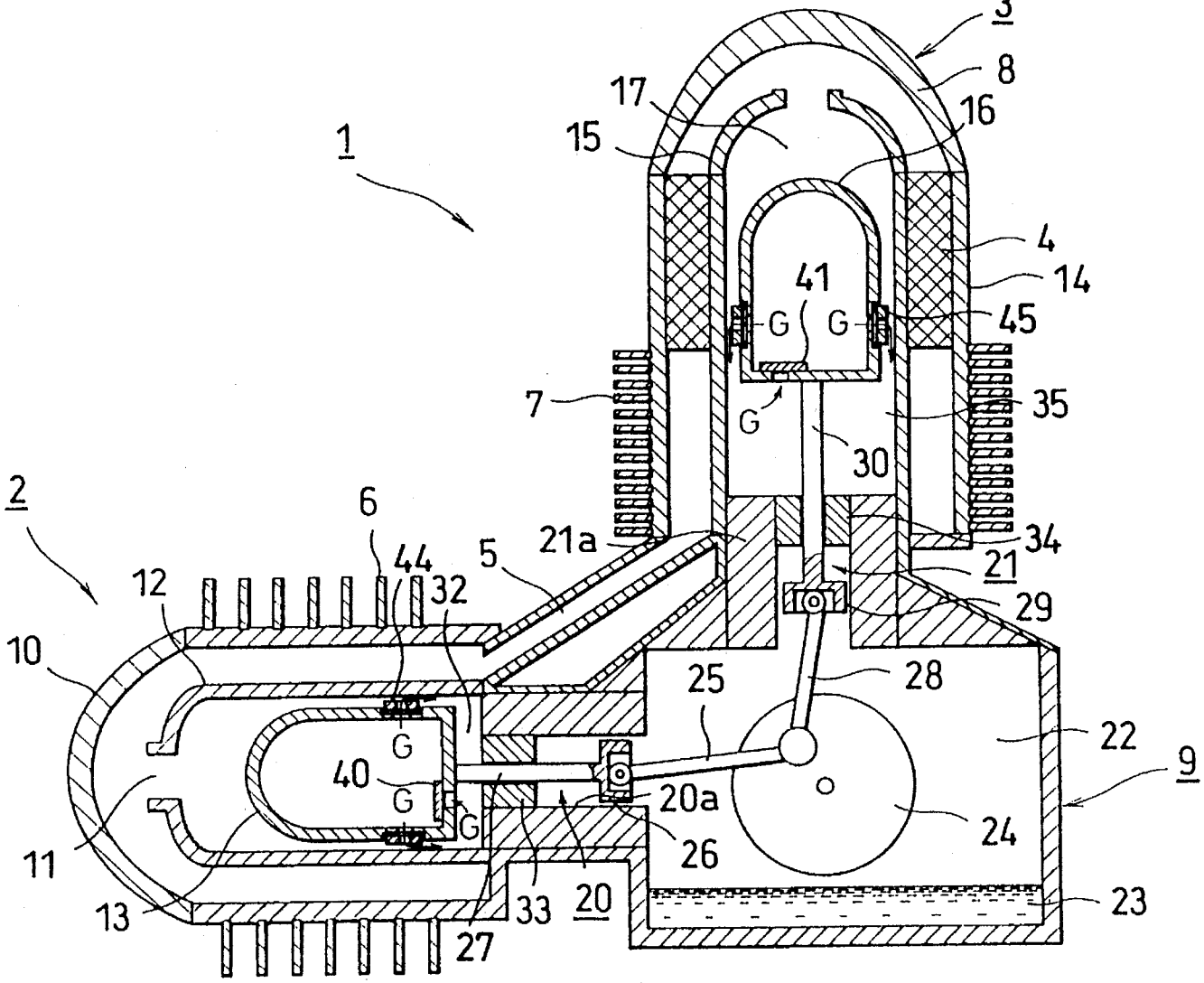
FIG. 3 is a schematic cross section of a second stirling type refrigerator, according to the invention.

FIG. 3 shows a second example of refrigeration apparatus according to the invention, in which like and corresponding elements carry the same reference numbers as in FIG. 1. This example is basically the same as the first example shown in FIG. 1, with a difference that the pistons 13 and 16 each have a piston ring 44/45, respectively, which has a plurality of bores formed such that the high pressure gas trapped in the cavity is ejected from the cylindrical surface of the piston ring facing the inner wall of the cylinder, forming a gas bearing as in the first example.

Figure 4:
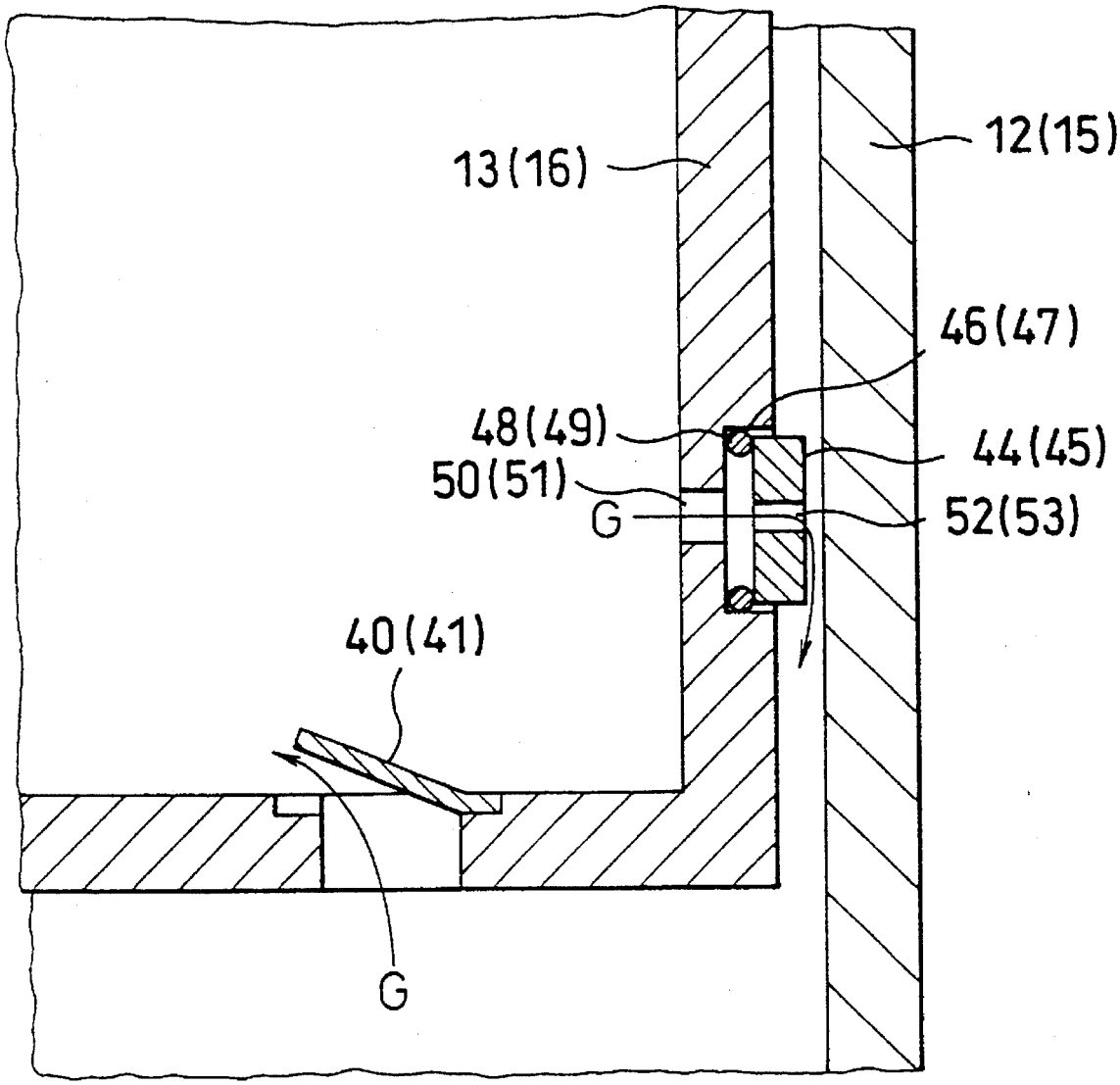
FIG. 4 is an enlarged partial view of the refrigerator of FIG. 3.

FIG. 4 shows enlarged partial cross sections of such pistons, illustrating the piston rings 44 and 45 mounted in circumferential grooves 6 and 47, respectively, formed on the pistons 13 and 16, respectively, together with seal rings 48 and 49, respectively. The groove 46 (47) as well as the piston ring 44 (45) has bores 50 and 52 (51 and 53) penetrating through the piston and the piston ring.

This second example of the invention may enjoy the same merits of invention as the first example described above, and a further merit that the piston rings 44 and 45 provide better gas bearings, thereby further increasing the durability of the refrigerator.

What we claim is:

1. A compression/expansion apparatus for compressing/expanding a gas in a cylinder by reciprocating a piston in said cylinder, characterized in that said piston has:

a cavity in said piston;

an opening formed in at least one of the opposite ends of said piston, and communicating with said cavity;

a check valve mounted on said opening for allowing said gas to flow from said cylinder into said cavity when the pressure of said gas is higher in the cylinder than in the cavity so as to maintain the pressure of said gas higher in said cavity than in said cylinder; and a multiplicity of bores communicating between said cavity and a cylindrical surface of said piston for ejecting the high pressure gas from said cavity into a gap between said piston and said cylinder.

2. An apparatus according to claim 1, wherein said piston has at least one piston ring on said cylindrical surface, said piston ring having a plurality of bores communicating with said cavity for ejecting said high pressure gas into a gap between said piston ring and the wall of said cylinder.

3. A refrigerator, comprising:

a gas compressor for compressing a gas in a cylinder by reciprocating a piston in said cylinder, said piston having: a cavity in said piston; an opening formed in a least one of the opposite ends of said piston, and communicating with said cavity; a check valve mounted on said opening for allowing said gas to flow from said cylinder into said cavity when the pressure of said gas is higher in the cylinder than in the cavity so as to maintain the pressure of said gas higher in said cavity than in said cylinder; and a multiplicity of bores communicating between said cavity and a cylindrical surface of said piston for ejecting the high pressure gas from said cavity into a gap between said piston and said cylinder;

said compressor having a compression space;

a gas expander for expanding a gas in a cylinder by reciprocating a piston in said cylinder, said piston having: a cavity in said piston; an opening formed in a least one of the opposite ends of said piston, and communicating with said cavity; a check valve mounted on said opening for allowing said gas to flow from said cylinder into said cavity when the pressure of said gas is higher in the cylinder than in the cavity so as to maintain the pressure of said gas higher in said cavity than in said cylinder; and a multiplicity of bores communicating between said cavity and a cylindrical surface of said piston for ejecting the high pressure gas from said cavity into a gap between said piston and said cylinder;

said expander having an expansion space;

a gas passage connecting said compression space of said gas compressor with said expansion space of said gas expander;

a regenerator provided in said gas passage, wherein said gas compressor and said gas expander are cyclically operated out of phase by a predetermined phase angle, thereby performing refrigeration of said gas.

4. A refrigerator as defined in claim 3, wherein each of said pistons has at least one piston ring on said cylindrical surface, said piston ring having a plurality of bores communicating with said cavity for ejecting said high pressure gas into a gap between said piston ring and the wall of said cylinder associated with said piston.

* * * * *